US008491317B2

(12) United States Patent
Vardanyan

(10) Patent No.: US 8,491,317 B2
(45) Date of Patent: Jul. 23, 2013

(54) COMPACT ALL-IN-ONE POWER ADAPTER

(76) Inventor: Hrant Vardanyan, Bellevue, WA (US)

( * ) Notice: Subject to any disclaimer, the term of this patent is extended or adjusted under 35 U.S.C. 154(b) by 48 days.

(21) Appl. No.: 13/239,720

(22) Filed: Sep. 22, 2011

(65) Prior Publication Data

US 2013/0078832 A1 Mar. 28, 2013

(51) Int. Cl.
*H01R 13/44* (2006.01)

(52) U.S. Cl.
USPC ..... 439/131; 363/142; 363/146

(58) Field of Classification Search
USPC ..... 439/131, 501, 170–173
See application file for complete search history.

(56) References Cited

U.S. PATENT DOCUMENTS 4,997,381 A * 3/1991 Oh ..... 439/172
4,999,752 A * 3/1991 Rogers et al. ..... 362/228
5,354,215 A * 10/1994 Viracola ..... 439/500
5,599,204 A * 2/1997 Glassford ..... 439/502
5,613,863 A * 3/1997 Klaus et al. ..... 439/131
5,648,712 A * 7/1997 Hahn ..... 320/111
5,829,993 A * 11/1998 Wu ..... 439/131
5,906,509 A * 5/1999 Wu ..... 439/518
5,967,807 A * 10/1999 Wu ..... 439/131
6,057,610 A * 5/2000 Nierescher ..... 307/72
6,126,460 A * 10/2000 Wu ..... 439/131
D486,788 S * 2/2004 Riede ..... D13/108
7,012,403 B2 * 3/2006 Hwang ..... 320/107
7,035,126 B1 * 4/2006 Lanni ..... 363/142
7,193,873 B2 * 3/2007 Lanni ..... 363/146
7,422,473 B2 * 9/2008 Portwood ..... 439/501
7,544,101 B1 * 6/2009 Tseng ..... 439/668
7,713,073 B2 * 5/2010 Lin ..... 439/131
7,753,721 B1 * 7/2010 Wu ..... 439/518
7,909,624 B2 * 3/2011 Iida ..... 439/131
2003/0228792 A1 * 12/2003 Lanni ..... 439/528

* cited by examiner

*Primary Examiner* — Amy Johnson
*Assistant Examiner* — Vladimir Imas

(57) ABSTRACT

A compact power adapter comprises an electric circuit, a casing and two electrically conductive AC prongs. A first portion of the casing contains the electric circuit. A second portion of the casing extends from a side of the first portion and has a generally cylindrical shape and size receivable in a car cigarette lighter. The second portion has two recesses and electrical contacts that receive electrical energy when the second portion is received in the car cigarette lighter. The AC prongs are receivable in an AC power outlet, and are rotatably coupled to the casing to rotate between a first position where the AC prongs extend from the casing approximately perpendicular to a longitudinal axis of the generally cylindrical shape of the second portion and a second position where each of the AC prongs is received in a respective one of the recesses of the second portion.

20 Claims, 12 Drawing Sheets

COMPACT ALL-IN-ONE POWER ADAPTER

BACKGROUND

1. Technical Field

The present disclosure generally relates to power adapters and chargers for electrically-powered devices.

2. Description of Related Art

There are lots of portable devices for everyday use such as portable phones, music players, video games, calculators, portable multimedia devices, and so on. A majority of those devices are equipped with rechargeable batteries and therefore require an external power supply or a charger. During normal use, a user may use or charge a portable device various times and at various places whenever and wherever there is a need for it, whether location of use or charging may be at home, in a vehicle, in a hotel, in an airport, etc.

A typical power adapter includes AC prongs for insertion into an AC wall-mount power outlet or a DC socket for a cigarette lighter. In today's market one particularly large class of portable devices are equipped with two separate power adapters, each capable for working only with a single type of power plug insertion. One of these power adapters is for the AC wall-mount power outlet and the other is for the vehicle DC socket.

Unfortunately, there often appears a situation when a portable device has a different type of plug than what is required. As such, for many users it is preferable to have a universal power adapter to run or charge their devices on the road, in their home, in a hotel, in an airport or elsewhere. At the same time people tend to prefer power adapters/chargers to have small and compact sizes, as opposed to large and bulky sizes, that can be carried comfortably in a pocket, stored in a small space, etc. A small variety of power adapters are available for use with both types of connectors as all-in-one power adapters: for use with an AC wall-mount power outlet or a vehicle DC outlet (e.g., a car cigarette lighter) with foldable AC prongs. However, even the most compact ones of those chargers are not small enough to be carried comfortably in a pocket, in a small space, etc. In many cases the foldable prongs tend to occupy more space than their minimal theoretical size requires.

SUMMARY

The present disclosure is directed to a compact all-in-one power adapter/charger. Various embodiments of the present disclosure provide a unique approach to improving the minimization of power adapter/chargers. A power adapter/charger according to embodiments of the present disclosure is at least two or three times smaller in size compared to existing products and technologies that are available in the market at the present time.

In one aspect, a compact power adapter may comprise an electric circuit, a casing, and a foldable AC prong mechanism. The electric circuit may output electrical energy in a first format in response to receiving electrical energy in a second format or a third format that is different than the second format. The casing may have a first portion and a second portion. The first portion may contain the electric circuit. The second portion may extend from a side of the first portion and have a generally cylindrical shape and size receivable in a car cigarette lighter. The second portion may have electrical contacts that receive electrical energy when the second portion is received in the car cigarette lighter. The second portion may further have two recesses. The foldable AC prong mechanism may comprise two electrically conductive AC prongs that are receivable in an AC power outlet. The AC prongs may be rotatably coupled to the casing to rotate in a first rotational direction such that the AC prongs are rotatable between a first position where the AC prongs extend from the casing approximately perpendicular to a longitudinal axis of the generally cylindrical shape of the second portion and a second position where the AC prongs point in a direction approximately parallel to the longitudinal axis of the generally cylindrical shape of the second portion. The AC prongs may be further rotatably coupled to the casing to rotate in a second rotational direction perpendicular to the first rotational direction such that the AC prongs are rotatable from the second position to a third position where each of the AC prongs is received in a respective one of the recesses of the second portion.

In one embodiment, the electrical energy in the first format may be 5-volt DC electricity, the electrical energy in the second format may be 12-volt DC electricity, and the electrical energy in the third format may be either 110-volt AC electricity or 220-volt AC electricity.

In one embodiment, the foldable AC prong mechanism may further comprise a connection piece coupled to the two AC prongs such that the AC prongs correspondingly rotate from the second position to the third position when the connection piece is moved in a first annular direction around the longitudinal axis of the second portion and that the AC prongs correspondingly rotate from the third position to the second position when the connection piece is moved in a second annular direction around the longitudinal axis of the second portion and opposite from the first annular direction.

In one embodiment, the compact power adapter may further comprise a first receptacle that receives a connector of a first type and a second receptacle that receives a connector of a second type different than the first type. The first receptacle may receive a Universal Serial Bus (USB) connector, and the second receptacle may receive a connector having a generally cylindrical shape.

In one embodiment, the compact power adapter may further comprise a receptacle that receives a USB connector.

In another embodiment, the compact power adapter may further comprise a receptacle that receives a connector having a generally cylindrical shape.

In another aspect, a compact power adapter may comprise an electric circuit, a casing, and a foldable AC prong mechanism. The electric circuit may output electrical energy in a first format in response to receiving electrical energy in a second format or a third format that is different than the second format. The casing may have a first portion and a second portion. The first portion may contain the electric circuit. The second portion may extend from a side of the first portion and may have a generally cylindrical shape and size receivable in a car cigarette lighter. The second portion may have electrical contacts that receive electrical energy when the second portion is received in the car cigarette lighter. The first portion may have a recess and the second portion may have a recess. The foldable AC prong mechanism may comprise first and second electrically conductive AC prongs that are receivable in an AC power outlet. The first AC prong may be rotatably coupled to the casing to rotate in a first rotational direction such that the first AC prong is rotatable between a first position where the first AC prong extends from the casing approximately perpendicular to a longitudinal axis of the generally cylindrical shape of the second portion and a second position where the first AC prong is received in the recess of the first portion. The second AC prong may be rotatably coupled to the casing to rotate in the first rotational direction such that the second AC prong is rotatable between a third position where the second AC prong extends from the casing approximately perpendicular to the longitudinal axis of the generally cylindrical shape of the second portion and a fourth position where the second AC prong is received in the recess of the second portion.

In one embodiment, the electrical energy in the first format may be 5-volt DC electricity, the electrical energy in the second format may be 12-volt DC electricity, and the electrical energy in the third format may be either 110-volt AC electricity or 220-volt AC electricity.

In one embodiment, the first AC prong may point in a first direction approximately parallel to the longitudinal axis of the generally cylindrical shape of the second portion when the first AC prong is in the second position, and the second AC prong may point in a second direction approximately parallel to the longitudinal axis of the generally cylindrical shape of the second portion that is opposite to the first direction when the second AC prong is in the fourth position.

In one embodiment, the foldable AC prong mechanism may further comprise a locking mechanism pivotably coupled between the first and second AC prongs to pivot between a first pivotal position and a second pivotal position. The locking mechanism may lock the first AC prong in the first position or the second position and may lock the second AC prong in the third position or the fourth position when the locking mechanism is in the first pivotal position. The locking mechanism may allow the first AC prong to rotate between the first and second positions and the second AC prong to rotate between the third and fourth positions when the locking mechanism is in the second pivotal position.

In one embodiment, the compact power adapter may further comprise a first receptacle that receives a connector of a first type and a second receptacle that receives a connector of a second type different than the first type. The first receptacle may receive a USB connector, and the second receptacle may receive a connector having a generally cylindrical shape.

In one embodiment, the compact power adapter may further comprise a receptacle that receives a USB connector.

In another embodiment, the compact power adapter may further comprise a receptacle that receives a connector having a generally cylindrical shape.

In still another aspect, a compact power adapter may comprise an electric circuit, a casing, and two electrically conductive AC prongs. The electric circuit may output electrical energy in a first format in response to receiving electrical energy in a second format or a third format that is different than the second format. The casing may have a first portion and a second portion. The first portion may contain the electric circuit. The second portion may extend from a side of the first portion and may have a generally cylindrical shape and size receivable in a car cigarette lighter. The second portion may have electrical contacts that receive electrical energy when the second portion is received in the car cigarette lighter. The second portion may further have two recesses. A distal end of the second portion may point in a first direction away from the first portion. The two electrically conductive AC prongs may be receivable in an AC power outlet and rotatably coupled to the casing to rotate between a first position where the AC prongs extend from the casing approximately perpendicular to a longitudinal axis of the generally cylindrical shape of the second portion and a second position where each of the AC prongs is received in a respective one of the recesses of the second portion.

In one embodiment, the electrical energy in the first format may be 5-volt DC electricity, the electrical energy in the second format may be 12-volt DC electricity, and the electrical energy in the third format may be either 110-volt AC electricity or 220-volt AC electricity.

In one embodiment, the AC prongs may be rotatably coupled to the second portion near the distal end of the second portion such that a respective distal end of each of the AC prongs points in a second direction opposite to the first direction.

In another embodiment, the AC prongs may be rotatably coupled to the second portion at a location away from the distal end of the second portion such that a respective distal end of each of the AC prongs points in the first direction.

In one embodiment, the compact power adapter may further comprise a first receptacle that receives a connector of a first type and a second receptacle that receives a connector of a second type different than the first type. The first receptacle may receive a USB connector, and the second receptacle may receive a connector having a generally cylindrical shape.

These and other objectives of the present disclosure will be appreciated by those of ordinary skill in the art after reading the following detailed description of the preferred embodiments that are illustrated in the various figures and drawings.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF THE PREFERRED EMBODIMENTS

Overview

Figure 1A:
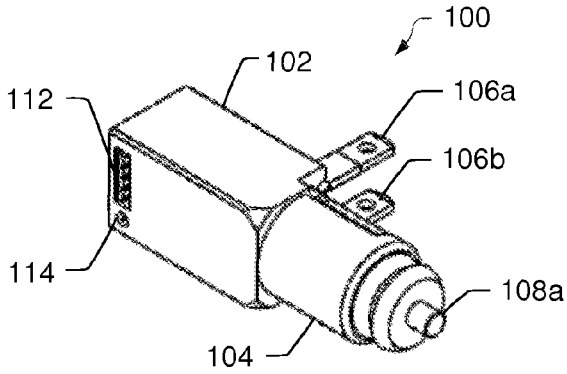
FIGS. 1A-1F and 2E illustrate a perspective view of a first embodiment of a compact power adapter in accordance with the present disclosure.
Figure 1B:
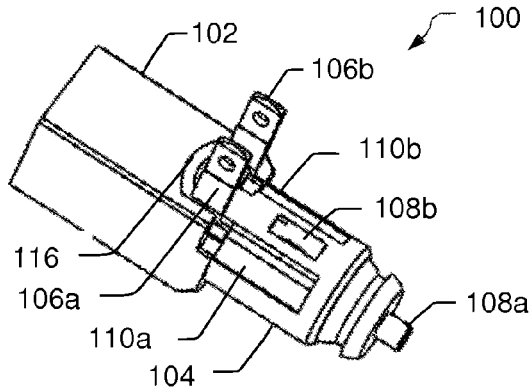
Figure 1C:
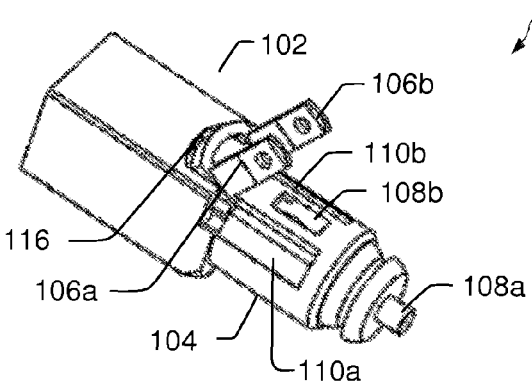
Figure 1D:
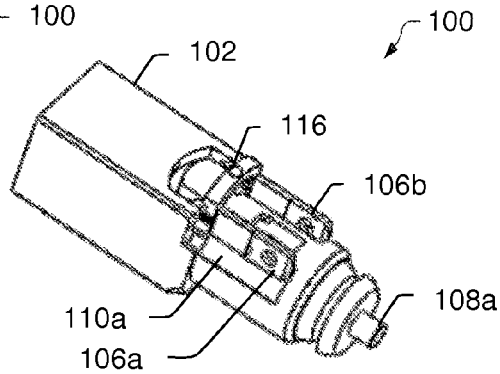
Figure 1E:
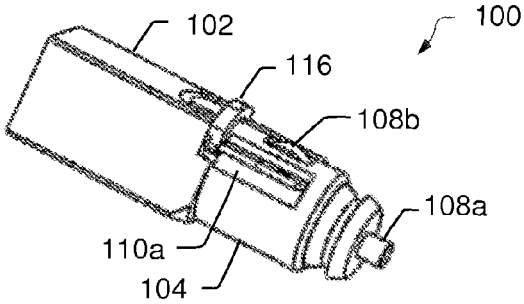
Figure 1F:
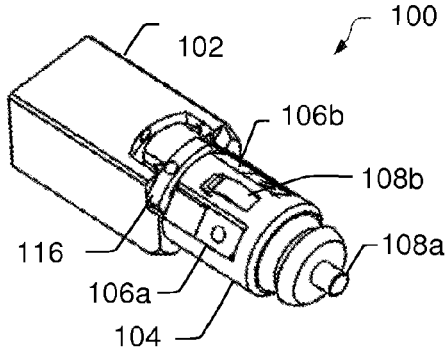
Figure 2A:
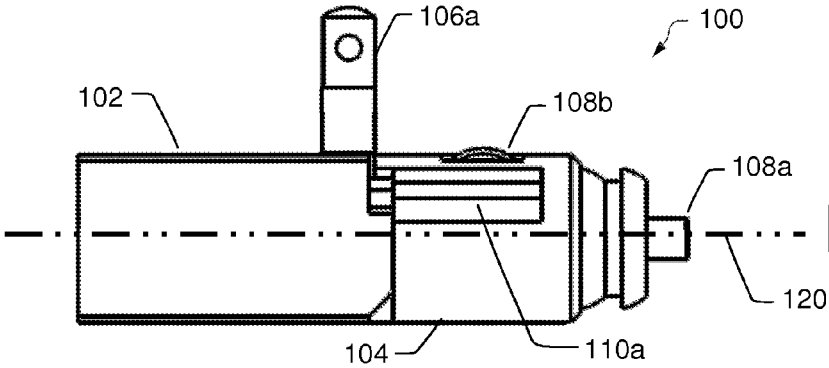
FIGS. 2A-2D illustrate a side view of the first embodiment of the compact power adapter in accordance with the present disclosure.
Figure 2B:
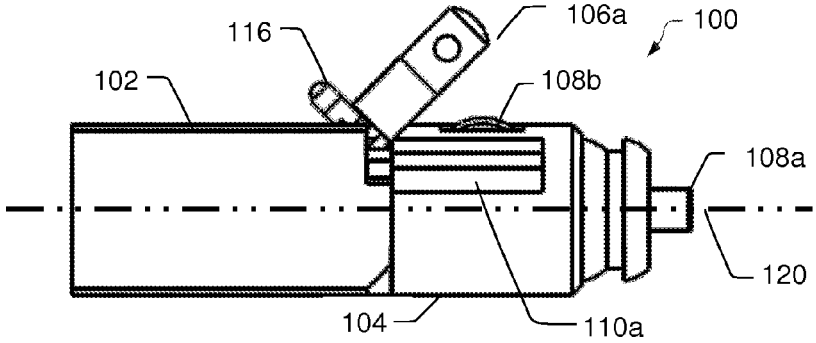
Figure 2C:
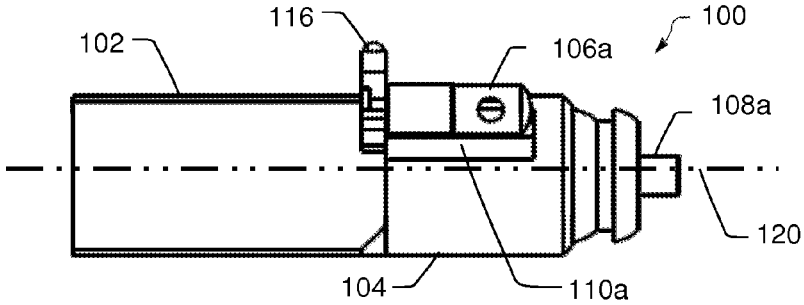
Figure 2D:
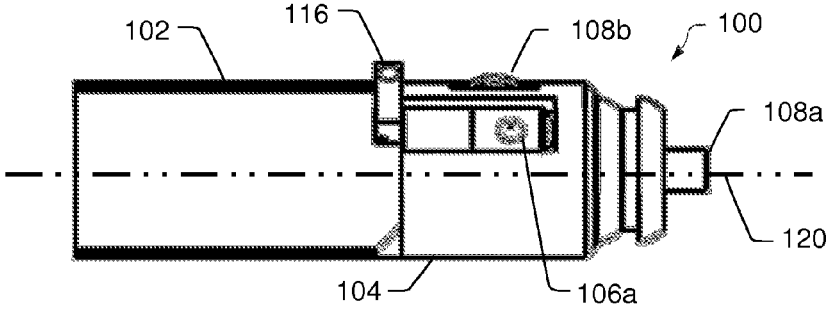
Figure 2E:
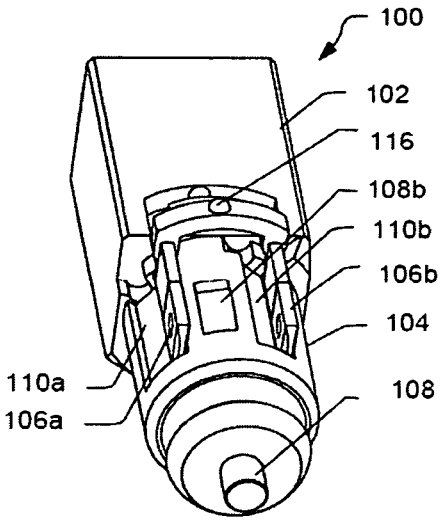

Various embodiments of the present disclosure relate to a compact power adapter with foldable AC prongs that, when folded, are retracted in the cylindrical portion of the power adapter that is configured to be received in a car cigarette lighter for 12-volt electrical connection. Folding or retracting the AC prongs into the cylindrical portion of the power adapter optimizes the miniaturization of the power adapter. It is advantageous to have the foldable AC prongs occupy this space because typically, except the plus-polarity and minus-polarity electrical connectors, nothing else fits there efficiently. This space is partially or not used at all in conventional power adapters. Besides, embodiments of the present disclosure offer a sleek and sturdy design.

Reference will now be made in detail to the preferred embodiments of the present disclosure, examples of which are illustrated in the accompanying drawings. Wherever possible, the same reference numbers are used in the drawings and the description to refer to the same or like parts.

First Exemplary Embodiment

FIGS. 1A-1F, 2A-2E and 3A-3F illustrate a compact power adapter 100 in accordance with the present disclosure. Detailed description of the first embodiment of the present disclosure is provided below with reference to these figures.

The compact power adapter 100 comprises an electric circuit, a casing, and a foldable AC prong mechanism. The electric circuit (not shown) outputs electrical energy in a first format in response to receiving electrical energy in a second format or a third format that is different than the second format. For example, the electric circuit can output 5-volt DC electricity when the electric circuit receives 12-volt DC electricity, 110-volt AC electricity, or 220-volt AC electricity. In other embodiments, the voltage and frequency of the received electrical energy as well as the outputted electrical energy may have other values. The above values are merely examples and thus do not limit the scope of the embodiments of the present disclosure.

The casing includes a first portion 102 and a second portion 104 that are made of electrically non-conductive materials such as, for example, plastic, Teflon, ceramic, a combination thereof, or any other suitable materials or composite. The first portion 102 houses or contains the electric circuit therein. The second portion 104 extends from a side of the first portion 102 and has a generally cylindrical shape and size configured so that the second portion 104 is receivable in a car cigarette lighter 90. The second portion 104 has electrical contacts 108*a*, 108*b* that receive electrical energy when the second portion 104 is received in the car cigarette lighter 90. One of the electrical contacts 108*a*, 108*b* is a positive-polarity contact and the other a negative-polarity contact. The second portion 104 has two recesses 110*a*, 110*b* defined therein.

The foldable AC prong mechanism comprises two electrically conductive AC prongs 106*a*, 106*b* that are receivable in an AC power outlet 30. The AC prongs 106*a*, 106*b* are made of a metal, a metal alloy, or any electrically conductive material, and the half portion of this part is molded with non-conductive materials such as for example plastic, Teflon, a combination thereof, or any other suitable materials or composite for isolating purposes to exclude any direct contact to the metallic portion while reaching to plugged to the AC outlet by the user. The AC prongs 106*a*, 106*b* are rotatably coupled to the casing to rotate in a first rotational direction such that the AC prongs 106*a*, 106*b* are rotatable between a first position (e.g., see FIGS. 1A, 1B and 2A) where the AC prongs 106*a*, 106*b* extend from the casing perpendicular to a longitudinal axis 120 of the generally cylindrical shape of the second portion 104 and a second position (e.g., see FIGS. 1D and 2C) where the AC prongs 106*a*, 106*b* point in a direction approximately parallel to the longitudinal axis 120 of the generally cylindrical shape of the second portion 104. The AC prongs 106*a*, 106*b* are further rotatably coupled to the casing to rotate in a second rotational direction perpendicular to the first rotational direction such that the AC prongs 106*a*, 106*b* are rotatable from the second position (e.g., see FIGS. 1D and 2C) to a third position (e.g., see FIGS. 1F and 2D) where each of the AC prongs 106*a*, 106*b* is received in a respective one of the recesses 110*a*, 110*b* of the second portion 104.

Figure 3A:
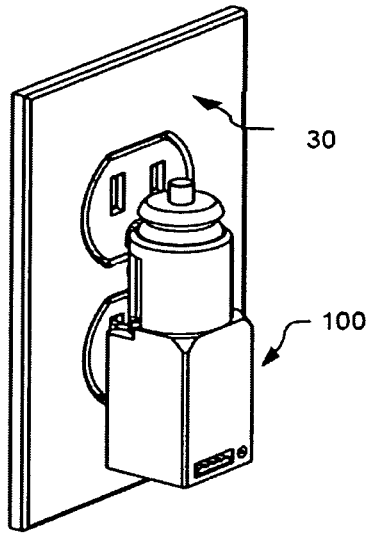
FIGS. 3A-3C illustrate a perspective view of the first embodiment of the compact power adapter plugged in an AC wall-mount power outlet in accordance with the present disclosure.
Figure 3B:
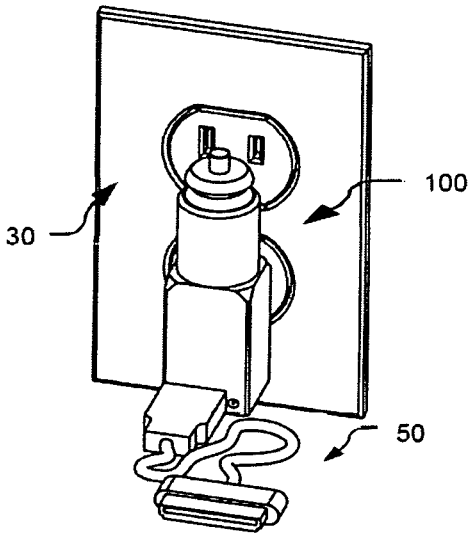
Figure 3C:
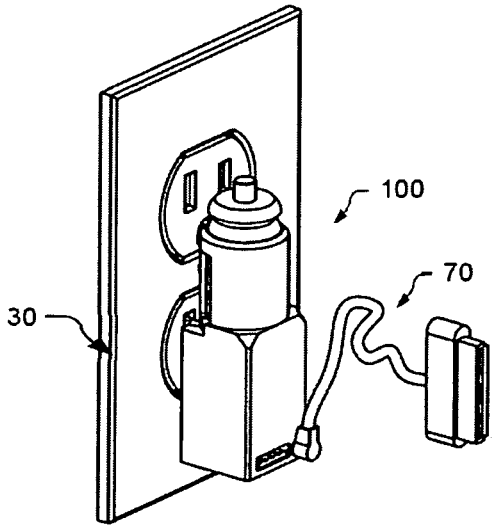
Figure 3D:
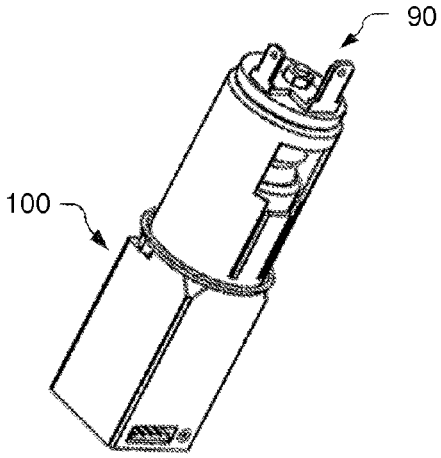
FIGS. 3D-3E illustrate a perspective view of the first embodiment of the compact power adapter plugged in a car cigarette lighter in accordance with the present disclosure.
Figure 3E:
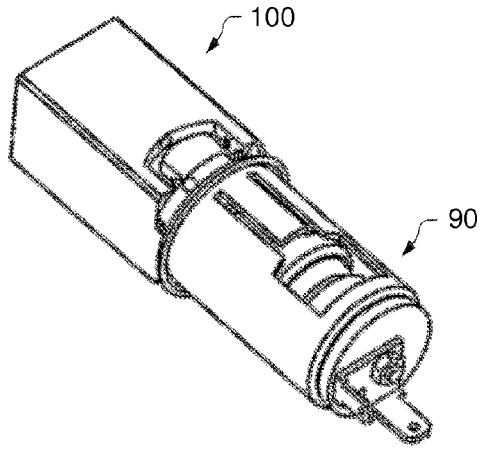

As can be seen in FIGS. 1A-1F and 2A-2D, when retracted the AC prongs 106*a*, 106*b* are received in the recesses 110*a*, 110*b* in the cylindrical part of the casing (e.g., the second portion 104) that is designed to be received in a typical car cigarette lighter such as the car cigarette lighter 90 shown in FIGS. 3D-3E. This novel and non-obvious design allows the size of the power adapter 100 to be more compact than conventional power adapters since the normally unused space in the cylindrical part of the casing to be received in a car cigarette lighter is now utilized for retracting the foldable AC prongs 106*a*, 106*b*.

In one embodiment, the foldable AC prong mechanism further comprises a connection piece 116 that is coupled to the two AC prongs 106*a*, 106*b* such that the AC prongs 106*a*, 106*b* correspondingly rotate from the second position (e.g., see FIGS. 1D and 2C) to the third position (e.g., see FIGS. 1F and 2D) when the connection piece 116 is moved in a first annular direction (e.g., counterclockwise as viewed from the angle shown in FIGS. 1D-1F) around the longitudinal axis 120 of the second portion 104. Similarly, the AC prongs 106*a*, 106*b* correspondingly rotate from the third position to the second position when the connection piece 116 is moved in a second annular direction (e.g., clockwise as viewed from the angle shown in FIGS. 1D-1F) around the longitudinal axis 120 of the second portion 104 and opposite from the first annular direction.

In one embodiment, the compact power adapter 100 further comprises a first receptacle 112 that receives a connector 50 of a first type and a second receptacle 114 that receives a connector 70 of a second type that is different than the first type. For example, as shown in FIGS. 1A and 3B, the first receptacle 112 may receive a Universal Serial Bus (USB) connector while the second receptacle 114 may receive a connector having a generally cylindrical shape.

Alternatively or additionally, the compact power adapter 100 comprises one or more receptacles to receive one or more USB connectors. Alternatively or additionally, the compact power adapter 100 comprises one or more receptacles to receive one or more connectors each having a generally cylindrical shape. Alternatively, the compact power adapter 100 comprises one or more receptacles to receive one or more USB connectors and one or more connectors each having a generally cylindrical shape.

Thus, FIGS. 1A-1F and 2A-2D illustrate the compact power adapter 100 having the AC prongs 106*a*, 106*b* in completely extended position ready to plug into a wall outlet, such as the wall-mount AC outlet 30 shown in FIGS. 3A-3C. FIGS. 1A-1F and 2A-2D also illustrate the AC prongs 106*a*, 106*b* in intermediate positions and fully folded or collapsed positions to allow the compact power adapter 100 to be in a portable configuration or to plug into a car cigarette lighter, such as the car cigarette lighter 90 shown in FIGS. 3D-3E.

Figure 3F:
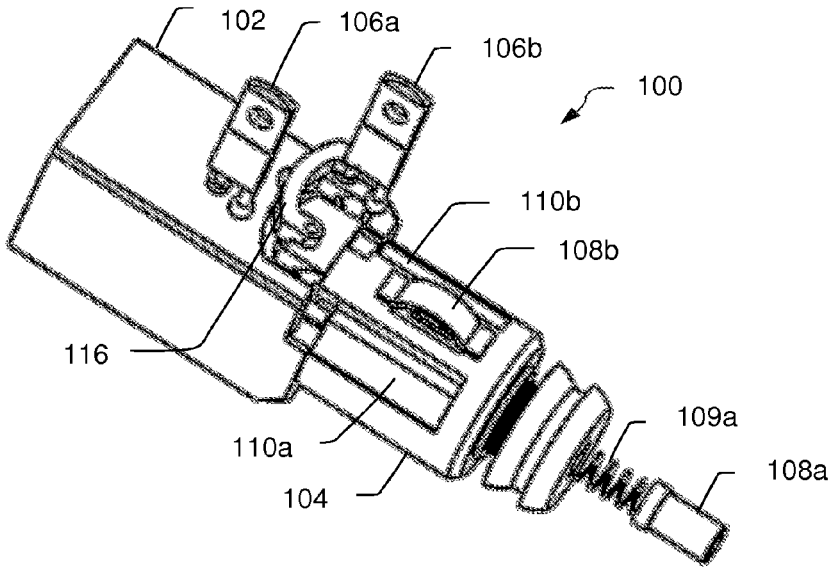
FIG. 3F illustrates a perspective exploded view of the first embodiment of the compact power adapter in accordance with the present disclosure.

FIG. 3F illustrates a perspective exploded view of the compact power adapter 100 showing the assembly parts of the compact power adapter 100. As shown in FIG. 3F, the electrical contacts 108*a*, 108*b* may be spring-loaded by one or more springs 109*a*.

Second Exemplary Embodiment

FIGS. 4A-4D, 5A-5D and 6A-6D illustrate a compact power adapter 200 in accordance with the present disclosure. Detailed description of the first embodiment of the present disclosure is provided below with reference to these figures.

The compact power adapter 200 comprises an electric circuit, a casing, and a foldable AC prong mechanism. The electric circuit (not shown) outputs electrical energy in a first format in response to receiving electrical energy in a second format or a third format that is different than the second format. For example, the electric circuit can output 5-volt DC electricity when the electric circuit receives 12-volt DC electricity, 110-volt AC electricity, or 220-volt AC electricity. In other embodiments, the voltage and frequency of the received electrical energy as well as the outputted electrical energy may have other values. The above values are merely examples and thus do not limit the scope of the embodiments of the present disclosure.

The casing includes a first portion 202 and a second portion 204 that are made of electrically non-conductive material such as, for example, plastic, ceramic, a combination thereof, or any other suitable material or composite. The first portion 202 houses or contains the electric circuit. The second portion 204 extends from a side of the first portion 202 and has a generally cylindrical shape and size configured so that the second portion 204 is receivable in a car cigarette lighter 90. The second portion 204 has electrical contacts 208*a*, 208*b* that receive electrical energy when the second portion 204 is received in the car cigarette lighter 90. One of the electrical contacts 208*a*, 208*b* is a positive-polarity contact and the other a negative-polarity contact. The first portion 202 has a recess 210*a* defined therein and the second portion 204 has a recess 210*b* defined therein.

The foldable AC prong mechanism comprises first and second electrically conductive AC prongs 206*a*, 206*b* that are receivable in an AC power outlet 30. The AC prongs 206*a*, 206*b* are made of a metal, a metal alloy, or any electrically conductive material, for example. The first AC prong 206*a* is rotatably coupled to the casing to rotate in a first rotational direction such that the first AC prong 206*a* is rotatable between a first position (e.g., see FIGS. 4A and 5A) where the first AC prong 206*a* extends from the casing approximately perpendicular to a longitudinal axis 220 of the generally cylindrical shape of the second portion 204 and a second position (e.g., see FIGS. 4C-4D and 5C-5D) where the first AC prong 206*a* is received in the recess 210*a* of the first portion 202. The second AC prong 206*b* is rotatably coupled to the casing to rotate in the first rotational direction such that the second AC prong 206*b* is rotatable between a third position (e.g., see FIGS. 4A and 5A) where the second AC prong 206*b* extends from the casing approximately perpendicular to the longitudinal axis 220 of the generally cylindrical shape of the second portion 204 and a fourth position (e.g., see FIGS. 4C-4D and 5C-5D) where the second AC prong 206*b* is received in the recess 210*b* of the second portion 204.

Figure 6A:
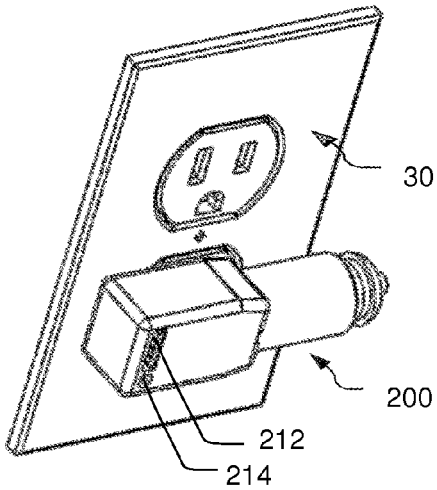
FIG. 6A illustrates a perspective view of the second embodiment of the compact power adapter plugged in an AC wall-mount power outlet in accordance with the present disclosure.
Figure 6B:
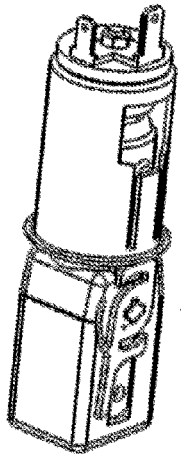
FIGS. 6B-6C illustrate a perspective view of the second embodiment of the compact power adapter plugged in a car cigarette lighter in accordance with the present disclosure.
Figure 6C:
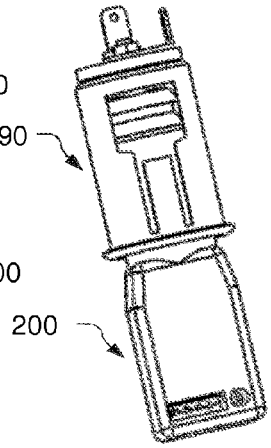

As can be seen in FIGS. 4A-4D and 5A-5D, when retracted the AC prongs 206*a*, 206*b* are received in the recesses 210*a*, 210*b* in the cylindrical part of the casing (e.g., the second portion 204) that is designed to be received in a typical car cigarette lighter such as the car cigarette lighter 90 shown in FIGS. 6B-6C. This novel and non-obvious design allows the size of the power adapter 200 to be more compact than conventional power adapters since the normally unused space in the cylindrical part of the casing to be received in a car cigarette lighter is now utilized for retracting the foldable AC prongs 206*a*, 206*b*.

In one embodiment, the first AC prong 206*a* points in a first direction approximately parallel to the longitudinal axis 220 of the generally cylindrical shape of the second portion 204 when the first AC prong 206*a* is in the second position (e.g., see FIGS. 4C-4D and 5C-5D). The second AC prong 206*b* points in a second direction approximately parallel to the longitudinal axis 220 of the generally cylindrical shape of the second portion 204, with the second direction being opposite to the first direction, when the second AC prong 206*b* is in the fourth position (e.g., see FIGS. 4C-4D and 5C-5D).

Figure 4A:
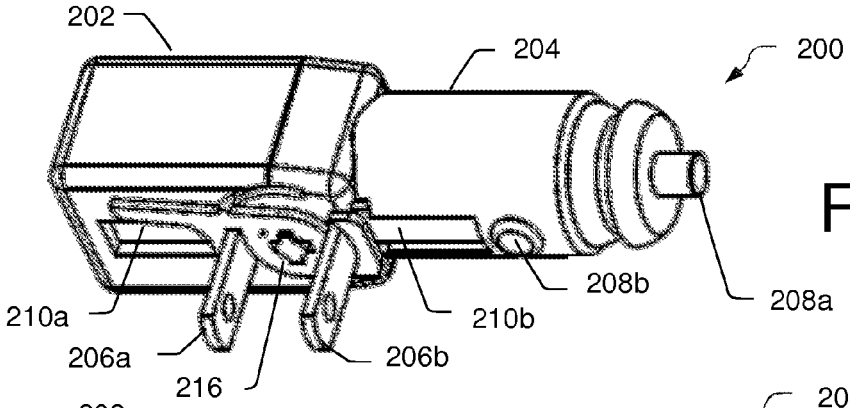
FIGS. 4A-4D illustrate a perspective view of a second embodiment of a compact power adapter in accordance with the present disclosure.
Figure 4B:
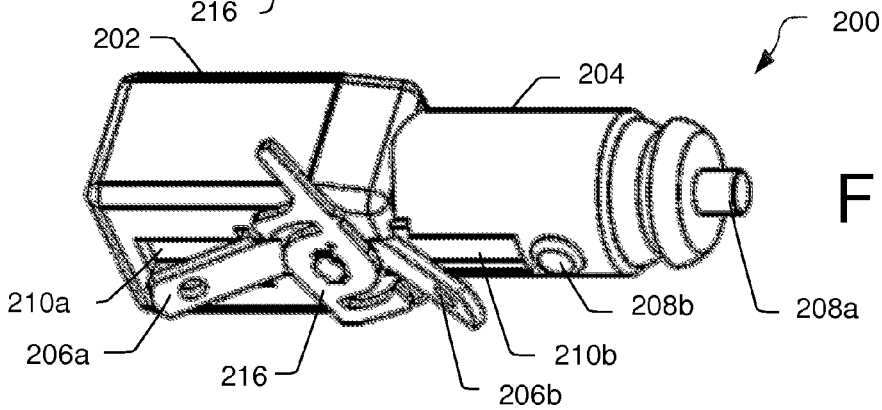
Figure 4C:
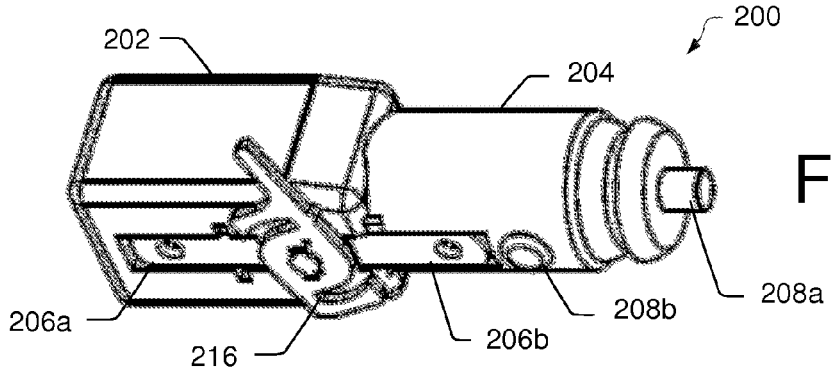
Figure 4D:
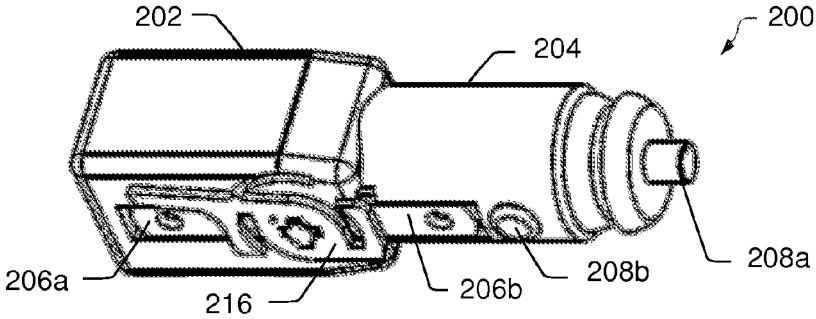
Figure 5A:
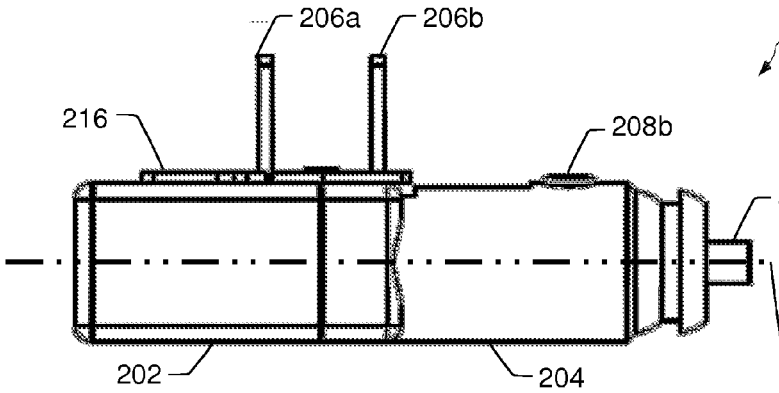
FIGS. 5A-5C illustrate a side view of the second embodiment of the compact power adapter in accordance with the present disclosure.
Figure 5B:
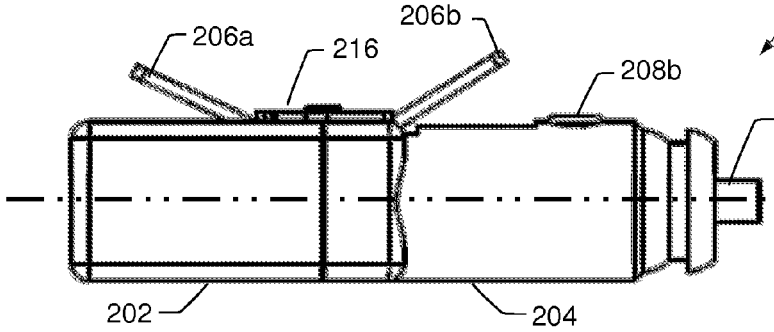
Figure 5C:
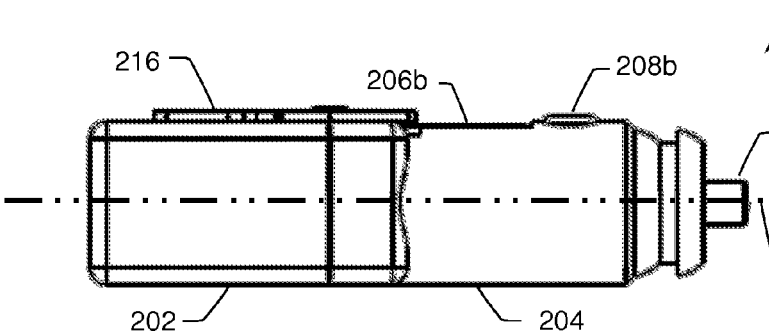
Figure 5D:
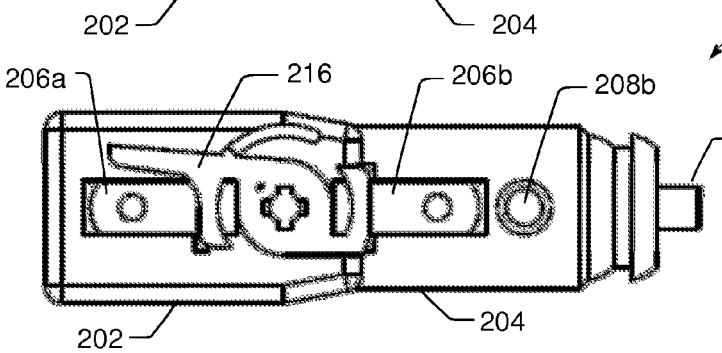
FIG. 5D illustrates a top view of the second embodiment of the compact power adapter in accordance with the present disclosure.

In one embodiment, the foldable AC prong mechanism further comprises a locking mechanism 216 pivotably coupled between the first and second AC prongs 206*a*, 206*b* to pivot between a first pivotal position (e.g., see FIGS. 4A, 4D and 5D) and a second pivotal position (e.g., see FIGS. 4B-4C). The locking mechanism 216 locks the first AC prong 206*a* in the first position or the second position and locks the second AC prong 206*b* in the third position or the fourth position when the locking mechanism 216 is in the first pivotal position. The locking mechanism 216 allows the first AC prong 206*a* to rotate between the first and second positions and the second AC prong 206*b* to rotate between the third and fourth positions when the locking mechanism 216 is in the second pivotal position. In one embodiment, the locking mechanism is spring-loaded. In another embodiment, the locking mechanism is not spring-loaded.

In one embodiment, the compact power adapter 200 further comprises a first receptacle 212 that receives a connector 50 of a first type and a second receptacle 214 that receives a connector 70 of a second type that is different than the first type. For example, the first receptacle 212 may receive a USB connector while the second receptacle 214 may receive a connector having a generally cylindrical shape.

Alternatively or additionally, the compact power adapter 200 may comprise one or more receptacles to receive one or more USB connectors. Alternatively or additionally, the compact power adapter 200 may comprise one or more receptacles to receive one or more connectors each having a generally cylindrical shape. Alternatively, the compact power adapter 100 may comprise one or more receptacles to receive one or more USB connectors and one or more connectors each having a generally cylindrical shape.

Thus, FIGS. 4A-4D and 5A-5D illustrate the compact power adapter 200 having the AC prongs 206*a*, 206*b* in completely extended position ready to plug into a wall outlet, such as the wall-mount AC outlet 30 shown in FIG. 6A. FIGS. 4A-4D and 5A-5D also illustrate the AC prongs 206*a*, 206*b* in intermediate positions and fully folded or collapsed positions to allow the compact power adapter 200 to be in a portable configuration or to plug into a car cigarette lighter, such as the car cigarette lighter 90 shown in FIGS. 6B-6C.

Figure 6D:
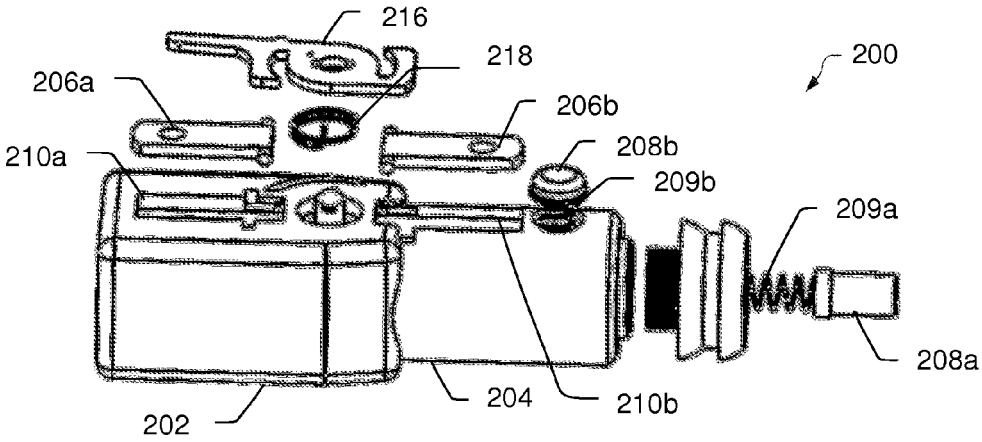
FIG. 6D illustrates a perspective exploded view of the second embodiment of the compact power adapter in accordance with the present disclosure.
Figure 7A:
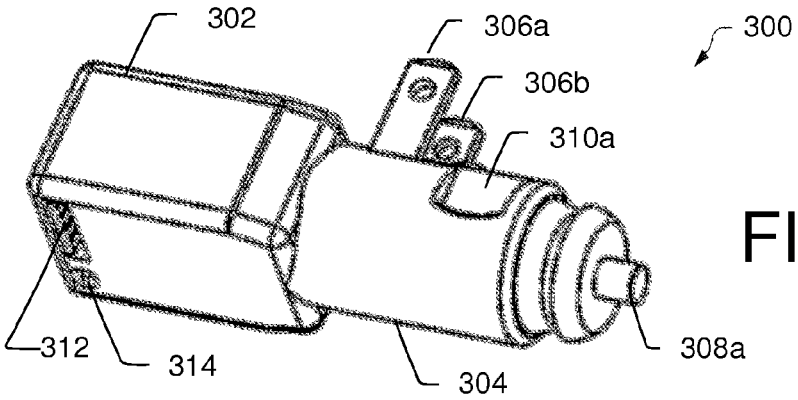
FIGS. 7A-7B illustrate a perspective view of a third embodiment of the compact power adapter in accordance with the present disclosure.
Figure 7B:
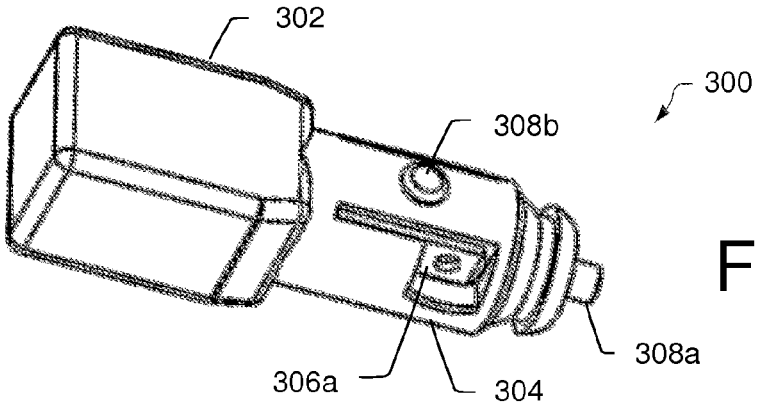
Figure 8A:
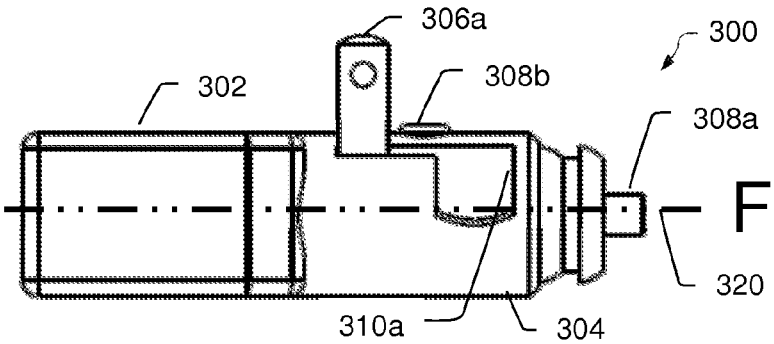
FIGS. 8A-8B illustrate a side view of the third embodiment of the compact power adapter in accordance with the present disclosure.
Figure 8B:
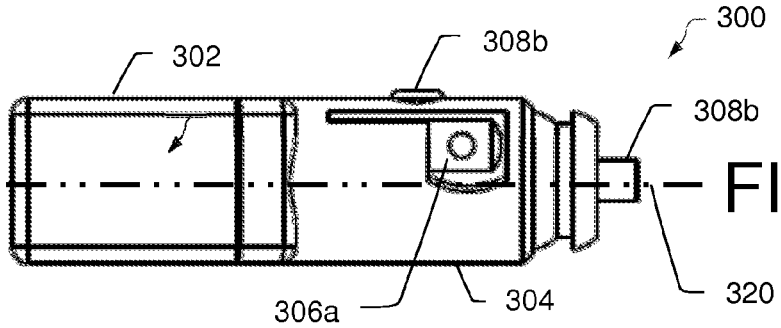

FIG. 6D illustrates a perspective exploded view of the compact power adapter 200 showing the assembly parts of the compact power adapter 100. As shown in FIG. 6D, the electrical contacts 208*a*, 208*b* may be spring-loaded by one or more springs 209*a*.

Third Exemplary Embodiment

FIGS. 7A-7B, 8A-8B and 9A-9C illustrate a compact power adapter 300 in accordance with the present disclosure. Detailed description of the first embodiment of the present disclosure is provided below with reference to these figures.

The compact power adapter 300 comprises an electric circuit, a casing, and two electrically conductive AC prongs 306*a*, 306*b*. The electric circuit (not shown) outputs electrical energy in a first format in response to receiving electrical energy in a second format or a third format that is different than the second format. For example, the electric circuit can output 5-volt DC electricity when the electric circuit receives 12-volt DC electricity, 110-volt AC electricity, or 220-volt AC electricity. In other embodiments, the voltage and frequency of the received electrical energy as well as the outputted electrical energy may have other values. The above values are merely examples and thus do not limit the scope of the embodiments of the present disclosure.

The casing includes a first portion 302 and a second portion 304 that are made of electrically non-conductive material such as, for example, plastic, ceramic, a combination thereof, or any other suitable material or composite. The first portion 302 houses or contains the electric circuit. The second portion 304 extends from a side of the first portion 302 and has a generally cylindrical shape and size configured so that the second portion 304 is receivable in a car cigarette lighter 90. The second portion 304 has electrical contacts 308*a*, 308*b* that receive electrical energy when the second portion 304 is received in the car cigarette lighter 90. One of the electrical contacts 308*a*, 308*b* is a positive-polarity contact and the other a negative-polarity contact. The second portion 304 has two recesses 310*a*, 301*b* defined therein. A distal end of the second portion 304 points in a first direction (e.g., pointing to the right in FIGS. 7A-7B and 8A-8B) away from the first portion 302.

The two electrically conductive AC prongs 306*a*, 306*b* are receivable in an AC power outlet 30. The AC prongs 306*a*, 306*b* are made of a metal, a metal alloy, or any electrically conductive material, for example. The AC prongs 306*a*, 306*b* are rotatably coupled to the casing to rotate between a first position (e.g., see FIGS. 7A and 8A) where the AC prongs 306*a*, 306*b* extend from the casing approximately perpendicular to a longitudinal axis 320 of the generally cylindrical shape of the second portion 304 and a second position (e.g., see FIGS. 7B and 8B) where each of the AC prongs 306*a*, 306*b* is received in a respective one of the recesses 310*a*, 310*b* of the second portion 304.

The AC prongs 306*a*, 306*b* are rotatably coupled to the second portion 304 at a location away from the distal end of the second portion 304 such that a respective distal end of each of the AC prongs 306*a*, 306*b* points in the first direction (e.g., pointing to the right in FIGS. 7A-7B and 8A-8B).

Figure 9A:
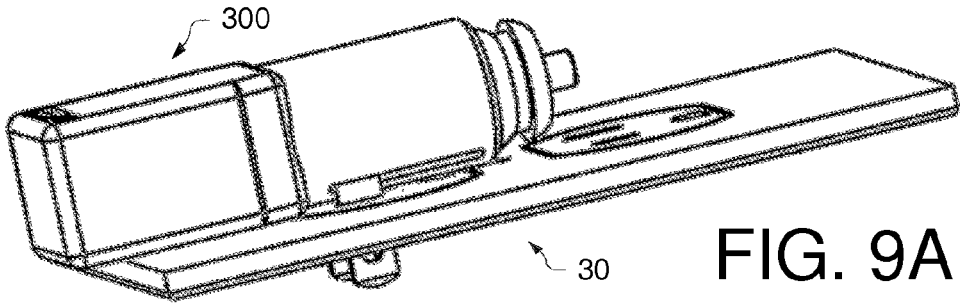
FIG. 9A illustrates a perspective view of the third embodiment of the compact power adapter plugged in an AC wall-mount power outlet in accordance with the present disclosure.
Figure 9B:
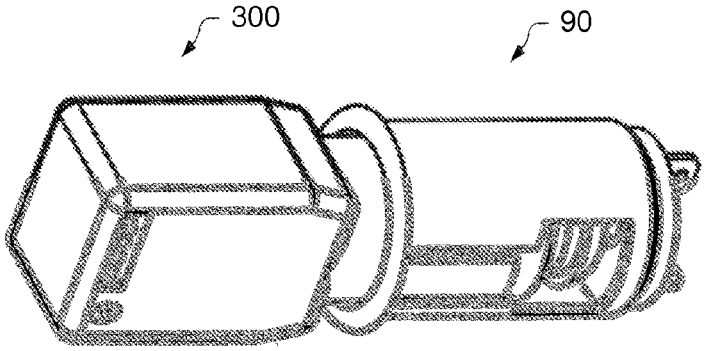
FIG. 9B illustrates a perspective view of the third embodiment of the compact power adapter plugged in a car cigarette lighter in accordance with the present disclosure.
Figure 9C:
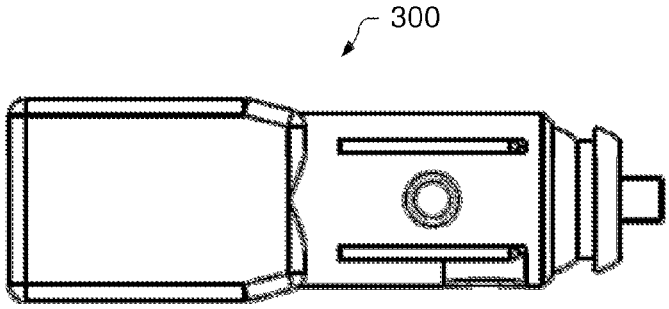
FIG. 9C illustrates a top view of the third embodiment of the compact power adapter in accordance with the present disclosure.
Figure 10A:
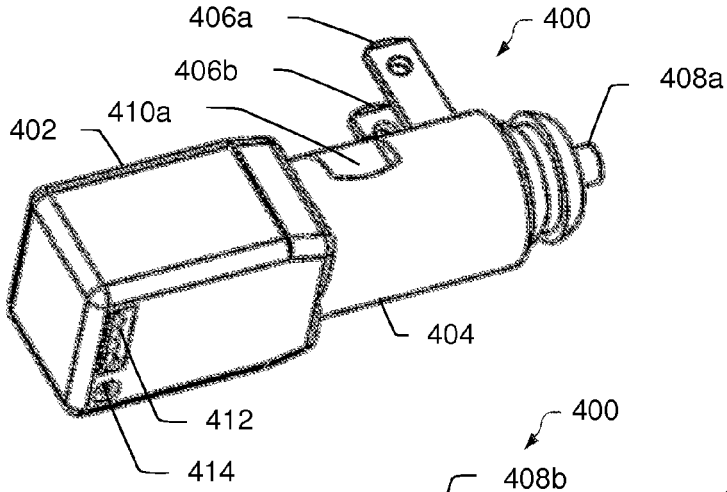
FIGS. 10A-10B illustrate a perspective view of a fourth embodiment of the compact power adapter in accordance with the present disclosure.
Figure 10B:
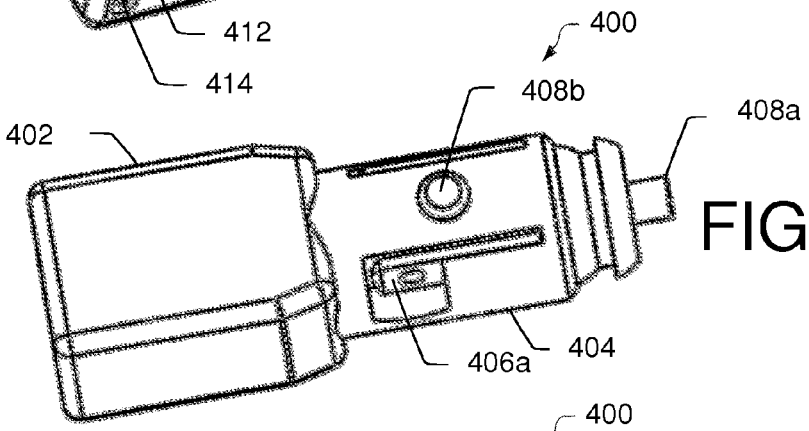
Figure 11A:
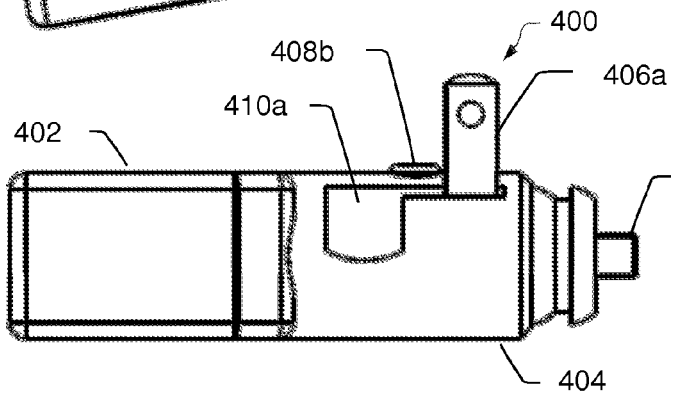
FIGS. 11A-11B illustrate a side view of the fourth embodiment of the compact power adapter in accordance with the present disclosure.
Figure 11B:
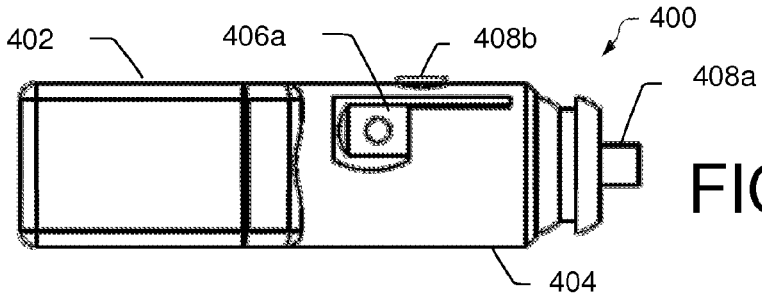
Figure 12A:
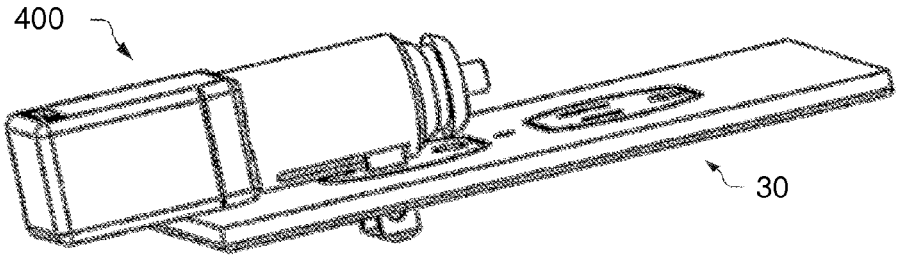
FIG. 12A illustrates a perspective view of the fourth embodiment of the compact power adapter plugged in an AC wall-mount power outlet in accordance with the present disclosure.
Figure 12B:
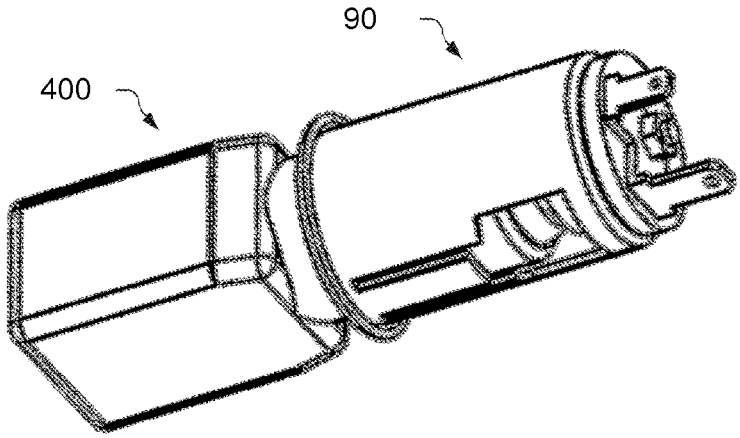
FIG. 12B illustrates a perspective view of the fourth embodiment of the compact power adapter plugged in a car cigarette lighter in accordance with the present disclosure.
Figure 12C:
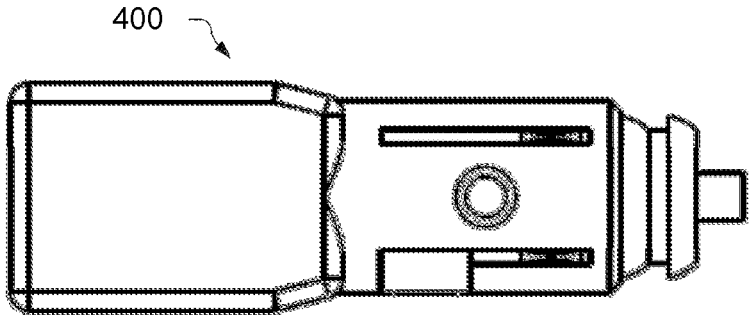
FIG. 12C illustrates a top view of the fourth embodiment of the compact power adapter in accordance with the present disclosure.

As can be seen in FIGS. 7A-7B, 8A-8B and 9A-9C, when retracted the AC prongs 306*a*, 306*b* are received in the recesses 310*a*, 310*b* in the cylindrical part of the casing (e.g., the second portion 304) that is designed to be received in a typical car cigarette lighter such as the car cigarette lighter 90 shown in FIG. 9B. This novel and non-obvious design allows the size of the power adapter 300 to be more compact than conventional power adapters since the normally unused space in the cylindrical part of the casing to be received in a car cigarette lighter is now utilized for retracting the foldable AC prongs 306*a*, 306*b*.

In one embodiment, the compact power adapter 300 further comprises a first receptacle 312 that receives a connector 50 of a first type and a second receptacle 314 that receives a connector 70 of a second type that is different than the first type. For example, the first receptacle 312 may receive a Universal Serial Bus (USB) connector while the second receptacle 314 may receive a connector having a generally cylindrical shape.

Alternatively or additionally, the compact power adapter 300 comprises one or more receptacles to receive one or more USB connectors. Alternatively or additionally, the compact power adapter 300 comprises one or more receptacles to receive one or more connectors each having a generally cylindrical shape. Alternatively, the compact power adapter 300 comprises one or more receptacles to receive one or more USB connectors and one or more connectors each having a generally cylindrical shape.

Fourth Exemplary Embodiment

FIGS. 10A-10B, 11A-11B and 12A-12C illustrate a compact power adapter 400 in accordance with the present disclosure. Detailed description of the first embodiment of the present disclosure is provided below with reference to these figures.

The compact power adapter 400 comprises an electric circuit, a casing, and two electrically conductive AC prongs 406*a*, 406*b*. The electric circuit (not shown) outputs electrical energy in a first format in response to receiving electrical energy in a second format or a third format that is different than the second format. For example, the electric circuit can output 5-volt DC electricity when the electric circuit receives 12-volt DC electricity, 110-volt AC electricity, or 220-volt AC electricity. In other embodiments, the voltage and frequency of the received electrical energy as well as the outputted electrical energy may have other values. The above values are merely examples and thus do not limit the scope of the embodiments of the present disclosure.

The casing includes a first portion 402 and a second portion 404 that are made of electrically non-conductive material such as, for example, plastic, ceramic, a combination thereof, or any other suitable material or composite. The first portion 402 houses or contains the electric circuit. The second portion 404 extends from a side of the first portion 402 and has a generally cylindrical shape and size configured so that the second portion 404 is receivable in a car cigarette lighter 90. The second portion 404 has electrical contacts 408*a*, 408*b* that receive electrical energy when the second portion 404 is received in the car cigarette lighter 90. One of the electrical contacts 408*a*, 408*b* is a positive-polarity contact and the other a negative-polarity contact. The second portion 404 has two recesses 410*a*, 401*b* defined therein. A distal end of the second portion 404 points in a first direction (e.g., pointing to the right in FIGS. 10A-10B and 11A-11B) away from the first portion 402.

The two electrically conductive AC prongs 406*a*, 406*b* are receivable in an AC power outlet 40. The AC prongs 406*a*, 406*b* are made of a metal, a metal alloy, or any electrically conductive material, for example. The AC prongs 406*a*, 406*b* are rotatably coupled to the casing to rotate between a first position (e.g., see FIGS. 10A and 11A) where the AC prongs 406*a*, 406*b* extend from the casing approximately perpendicular to a longitudinal axis 420 of the generally cylindrical shape of the second portion 404 and a second position (e.g., see FIGS. 10B and 11B) where each of the AC prongs 406*a*, 406*b* is received in a respective one of the recesses 410*a*, 410*b* of the second portion 404.

The AC prongs 406*a*, 406*b* are rotatably coupled to the second portion 404 near the distal end of the second portion 404 such that a respective distal end of each of the AC prongs 406*a*, 406*b* points in a second direction (e.g., pointing to the left in FIGS. 10A-10B and 11A-11B) opposite to the first direction.

As can be seen in FIGS. 10A-10B, 11A-11B and 9A-9C, when retracted the AC prongs 406*a*, 406*b* are received in the recesses 410*a*, 410*b* in the cylindrical part of the casing (e.g., the second portion 404) that is designed to be received in a typical car cigarette lighter such as the car cigarette lighter 90 shown in FIG. 9B. This novel and non-obvious design allows the size of the power adapter 400 to be more compact than conventional power adapters since the normally unused space in the cylindrical part of the casing to be received in a car cigarette lighter is now utilized for retracting the foldable AC prongs 406*a*, 406*b*.

In one embodiment, the compact power adapter 400 further comprises a first receptacle 412 that receives a connector 50 of a first type and a second receptacle 414 that receives a connector 70 of a second type that is different than the first type. For example, the first receptacle 412 may receive a Universal Serial Bus (USB) connector while the second receptacle 414 may receive a connector having a generally cylindrical shape.

Alternatively or additionally, the compact power adapter 400 comprises one or more receptacles to receive one or more USB connectors. Alternatively or additionally, the compact power adapter 400 comprises one or more receptacles to receive one or more connectors each having a generally cylindrical shape. Alternatively, the compact power adapter 400 comprises one or more receptacles to receive one or more USB connectors and one or more connectors each having a generally cylindrical shape.

Exemplary Embodiment

Figure 13A:
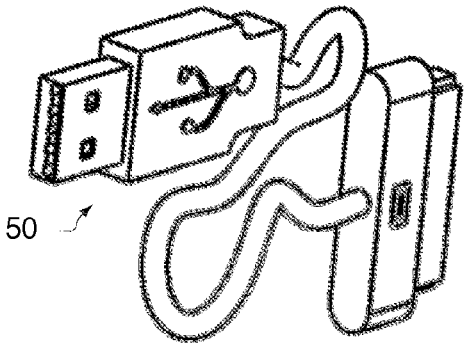
FIGS. 13A-13B illustrate a perspective view of exemplary connection cables for use with the various embodiments of the compact power adapter in accordance with the present disclosure.
Figure 13B:
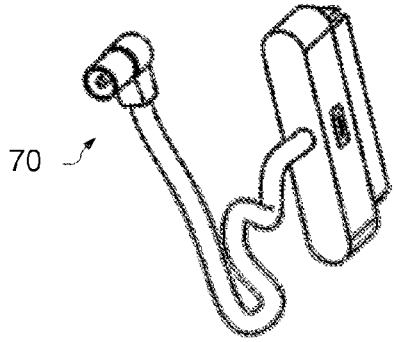

FIGS. 13A-13B illustrate a perspective view of exemplary connection cables for use with the various embodiments of the compact power adapter in accordance with the present disclosure. As shown in FIG. 13A, the connection cable has a USB connector 50 on one end and a connector for connecting to a portable device on the other end. As shown in FIG. 13B, the connection cable has a connector 70 having a generally cylindrical shape on one end and a connector for connecting to a portable device on the other end.

Figure 14A:
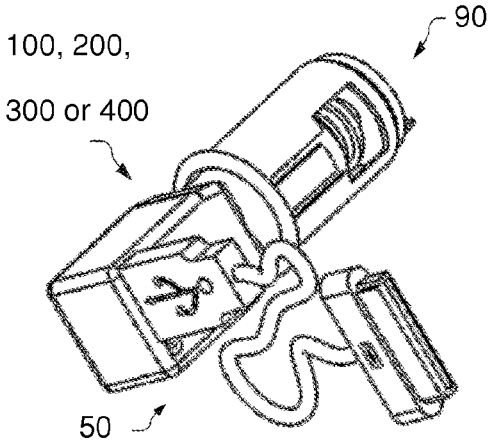
FIGS. 14A-14B illustrate a perspective view of exemplary connection cables connected to the compact power adapter that is plugged in a car cigarette lighter in accordance with the present disclosure.
Figure 14B:
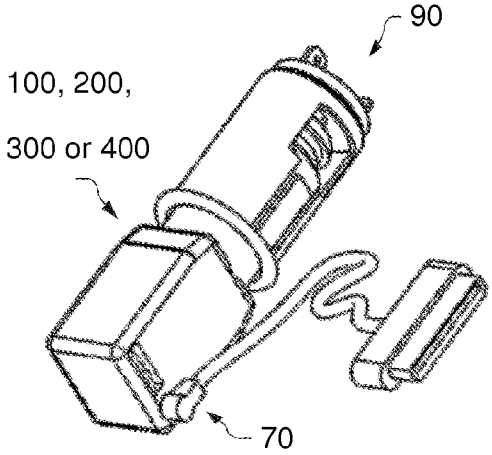

FIGS. 14A-14B illustrate a perspective view of exemplary connection cables connected to the compact power adapter that is plugged in the car cigarette lighter 90 in accordance with the present disclosure. The compact power adapter may be the compact power adapter 100 of FIGS. 1A-3F, the compact power adapter 200 of FIGS. 4A-6D, the compact power adapter 300 of FIGS. 7A-9C, or the compact power adapter 400 of FIGS. 10A-12C.

CONCLUSION

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims and their equivalents.

What is claimed is:

1. A compact power adapter, comprising:

an electric circuit that outputs electrical energy in a first format in response to receiving electrical energy in a second format or a third format that is different than the second format;

a casing having a first portion and a second portion, the first portion containing the electric circuit, the second portion extending from a side of the first portion and having a generally cylindrical shape and size receivable in a car cigarette lighter, the second portion having electrical contacts that receive electrical energy when the second portion is received in the car cigarette lighter, the second portion further having two recesses; and a foldable AC prong mechanism comprising two electrically conductive AC prongs that are receivable in an AC power outlet, the AC prongs rotatably coupled to the casing to rotate in a first rotational direction such that the AC prongs are rotatable between a first position where the AC prongs extend from the casing approximately perpendicular to a longitudinal axis of the generally cylindrical shape of the second portion and a second position where the AC prongs point in a direction approximately parallel to the longitudinal axis of the generally cylindrical shape of the second portion, the AC prongs further rotatably coupled to the casing to rotate in a second rotational direction perpendicular to the first rotational direction such that the AC prongs are rotatable from the second position to a third position where each of the AC prongs is received in a respective one of the recesses of the second portion.

2. A compact power adapter as recited in claim 1, wherein the electrical energy in the first format is 5-volt DC electricity, wherein the electrical energy in the second format is 12-volt DC electricity, and wherein the electrical energy in the third format is either 110-volt AC electricity or 220-volt AC electricity.

3. A compact power adapter as recited in claim 1, wherein the foldable AC prong mechanism further comprises:

a connection piece coupled to the two AC prongs such that the AC prongs correspondingly rotate from the second position to the third position when the connection piece is moved in a first annular direction around the longitudinal axis of the second portion and that the AC prongs correspondingly rotate from the third position to the second position when the connection piece is moved in a second annular direction around the longitudinal axis of the second portion and opposite from the first annular direction.

4. A compact power adapter as recited in claim 1, further comprising:

a first receptacle that receives a connector of a first type; and a second receptacle that receives a connector of a second type different than the first type.

5. A compact power adapter as recited in claim 4, wherein the first receptacle receives a Universal Serial Bus (USB) connector, and wherein the second receptacle receives a connector having a generally cylindrical shape.

6. A compact power adapter as recited in claim 1, further comprising:

a receptacle that receives a USB connector.

7. A compact power adapter as recited in claim 1, further comprising:

a receptacle that receives a connector having a generally cylindrical shape.

8. A compact power adapter, comprising:

an electric circuit that outputs electrical energy in a first format in response to receiving electrical energy in a second format or a third format that is different than the second format;

a casing having a first portion and a second portion, the first portion containing the electric circuit, the second portion extending from a side of the first portion and having a generally cylindrical shape and size receivable in a car cigarette lighter, the second portion having electrical contacts that receive electrical energy when the second portion is received in the car cigarette lighter, the first portion having a recess and the second portion having a recess; and a foldable AC prong mechanism comprising first and second electrically conductive AC prongs that are receivable in an AC power outlet, the first AC prong rotatably coupled to the casing to rotate in a first rotational direction such that the first AC prong is rotatable between a first position where the first AC prong extends from the casing approximately perpendicular to a longitudinal axis of the generally cylindrical shape of the second portion and a second position where the first AC prong is received in the recess of the first portion, the second AC prong rotatably coupled to the casing to rotate in the first rotational direction such that the second AC prong is rotatable between a third position where the second AC prong extends from the casing approximately perpendicular to the longitudinal axis of the generally cylindrical shape of the second portion and a fourth position where the second AC prong is received in the recess of the second portion.

9. A compact power adapter as recited in claim 8, wherein the first AC prong points in a first direction approximately parallel to the longitudinal axis of the generally cylindrical shape of the second portion when the first AC prong is in the second position, and wherein the second AC prong points in a second direction approximately parallel to the longitudinal axis of the generally cylindrical shape of the second portion that is opposite to the first direction when the second AC prong is in the fourth position.

10. A compact power adapter as recited in claim 8, wherein the foldable AC prong mechanism further comprises:

a locking mechanism pivotably coupled between the first and second AC prongs to pivot between a first pivotal position and a second pivotal position, the locking mechanism locking the first AC prong in the first position or the second position and locking the second AC prong in the third position or the fourth position when the locking mechanism is in the first pivotal position, the locking mechanism allowing the first AC prong to rotate between the first and second positions and the second AC prong to rotate between the third and fourth positions when the locking mechanism is in the second pivotal position.

11. A compact power adapter as recited in claim 8, further comprising:

a first receptacle that receives a connector of a first type; and a second receptacle that receives a connector of a second type different than the first type.

12. A compact power adapter as recited in claim 11, wherein the first receptacle receives a Universal Serial Bus (USB) connector, and wherein the second receptacle receives a connector having a generally cylindrical shape.

13. A compact power adapter as recited in claim 8, further comprising:

a receptacle that receives a USB connector.

14. A compact power adapter as recited in claim 8, further comprising:

a receptacle that receives a connector having a generally cylindrical shape.

15. A compact power adapter, comprising:

an electric circuit that outputs electrical energy in a first format in response to receiving electrical energy in a second format or a third format that is different than the second format;

a casing having a first portion and a second portion, the first portion containing the electric circuit, the second portion extending from a side of the first portion and having a generally cylindrical shape and size receivable in a car cigarette lighter, the second portion having electrical contacts that receive electrical energy when the second portion is received in the car cigarette lighter, the second portion further having two recesses, a distal end of the second portion pointing in a first direction away from the first portion; and two electrically conductive AC prongs that are receivable in an AC power outlet, the AC prongs rotatably coupled to the casing to rotate between a first position where the AC prongs extend from the casing approximately perpendicular to a longitudinal axis of the generally cylindrical shape of the second portion and a second position where each of the AC prongs is received in a respective one of the recesses of the second portion.

16. A compact power adapter as recited in claim 15, wherein the electrical energy in the first format is 5-volt DC electricity, wherein the electrical energy in the second format is 12-volt DC electricity, and wherein the electrical energy in the third format is either 110-volt AC electricity or 220-volt AC electricity.

17. A compact power adapter as recited in claim 15, wherein the AC prongs are rotatably coupled near the distal end of the second portion such that a respective distal end of each of the AC prongs points in a second direction opposite to the first direction.

18. A compact power adapter as recited in claim 15, wherein the AC prongs are rotatably coupled away from the distal end of the second portion such that a respective distal end of each of the AC prongs points in the first direction.

19. A compact power adapter as recited in claim 15, further comprising:

a first receptacle that receives a connector of a first type; and a second receptacle that receives a connector of a second type different than the first type.

20. A compact power adapter as recited in claim 19, wherein the first receptacle receives a Universal Serial Bus (USB) connector, and wherein the second receptacle receives a connector having a generally cylindrical shape.

* * * * *